US005715660A

United States Patent [19]

Balentine

[11] Patent Number: 5,715,660

[45] Date of Patent: Feb. 10, 1998

[54] AUTOMATED PRODUCT COLLECTION APPARATUS

[76] Inventor: Paul Balentine, P.O. Box 918, Mountain View, Ark. 72560

[21] Appl. No.: 567,539

[22] Filed: Dec. 5, 1995

[51] Int. Cl.[6] ..... B65B 1/30; B65B 1/32; B65B 43/52; B65B 57/10

[52] U.S. Cl. ..... 53/501; 53/493; 53/251; 53/500; 53/502

[58] Field of Search ..... 53/250, 249, 251, 53/252, 501, 502, 500, 495, 494, 493, 52

[56] References Cited

U.S. PATENT DOCUMENTS

| | | | |
|---|---|---|---|
| 2,633,251 | 3/1953 | Bruce | 53/500 |
| 2,897,772 | 8/1959 | Hunter | 53/250 X |
| 3,633,732 | 1/1972 | Russell et al. | 198/40 |
| 4,074,610 | 2/1978 | Lock et al. | 89/34 |
| 4,609,091 | 9/1986 | Dorner | 198/347 |
| 4,902,184 | 2/1990 | Fritz | 414/790.3 |
| 4,909,697 | 3/1990 | Bernard, II et al. | 414/331 |
| 4,993,907 | 2/1991 | Clark | 414/795.3 |
| 5,072,635 | 12/1991 | White | 82/124 |
| 5,083,411 | 1/1992 | Axmann | 53/252 |
| 5,186,086 | 2/1993 | Wetherill et al. | 82/124 |
| 5,321,929 | 6/1994 | Hanevold et al. | 53/250 X |
| 5,325,653 | 7/1994 | Boyd | 53/502 X |
| 5,337,880 | 8/1994 | Claycomb et al. | 198/347.3 |
| 5,517,799 | 5/1996 | Russell et al. | 53/250 |

*Primary Examiner*—James F. Coan
*Attorney, Agent, or Firm*—Ray F. Cox, Jr.

[57] ABSTRACT

An automated product collection apparatus comprising two vertical, endless belt conveyor systems and a horizontal conveyor. One vertical conveyors (the load station) is loaded with a number of empty containers which are transferred sequentially to the horizontal conveyor (the fill station). The horizontal conveyor moves an empty container into position to collect parts from process and production equipment. Sensing circuitry counts the parts loaded into each container to determine when each container is full or reaches a predetermined product count. The full container is moved to the second vertical conveyor system (the unload station) which accumulates the full containers until unloaded from the second vertical conveyor. Individual parts may be counted, the accumulated total of parts can be weighed, and inputs may be obtained from other automated production equipment.

7 Claims, 8 Drawing Sheets

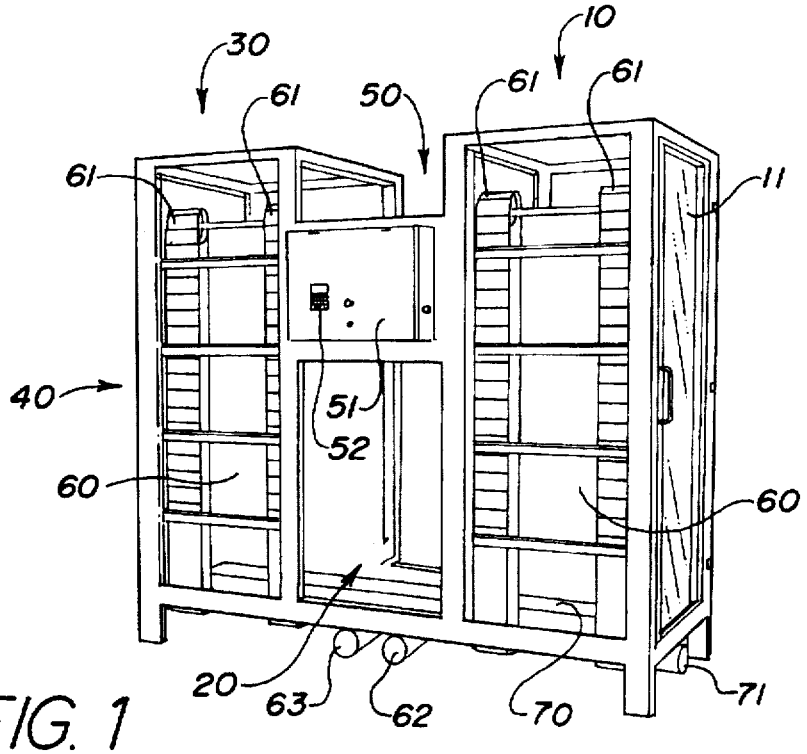
FIG. 1
FIG. 2
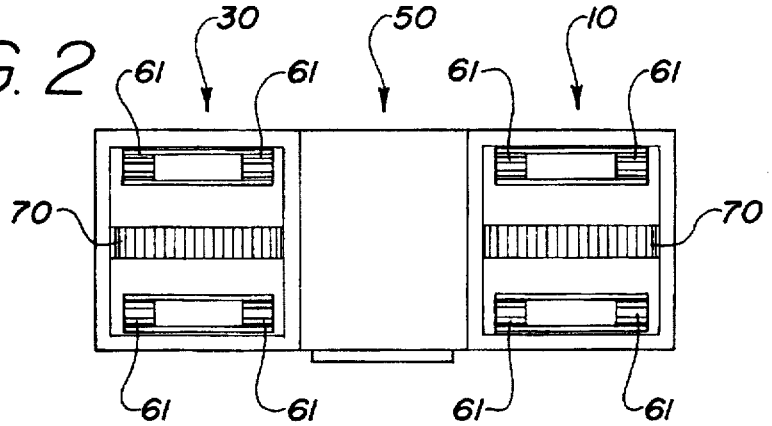
FIG. 2A
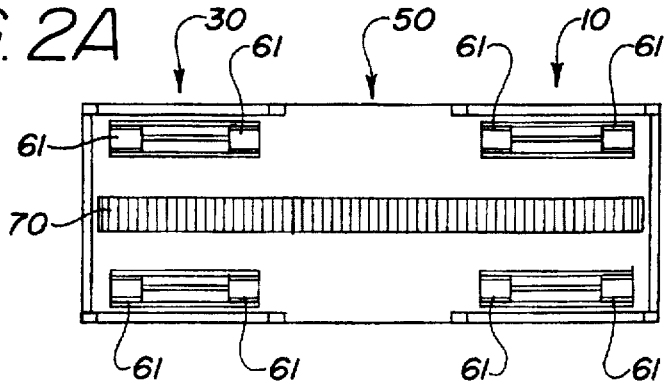

FIG. 3
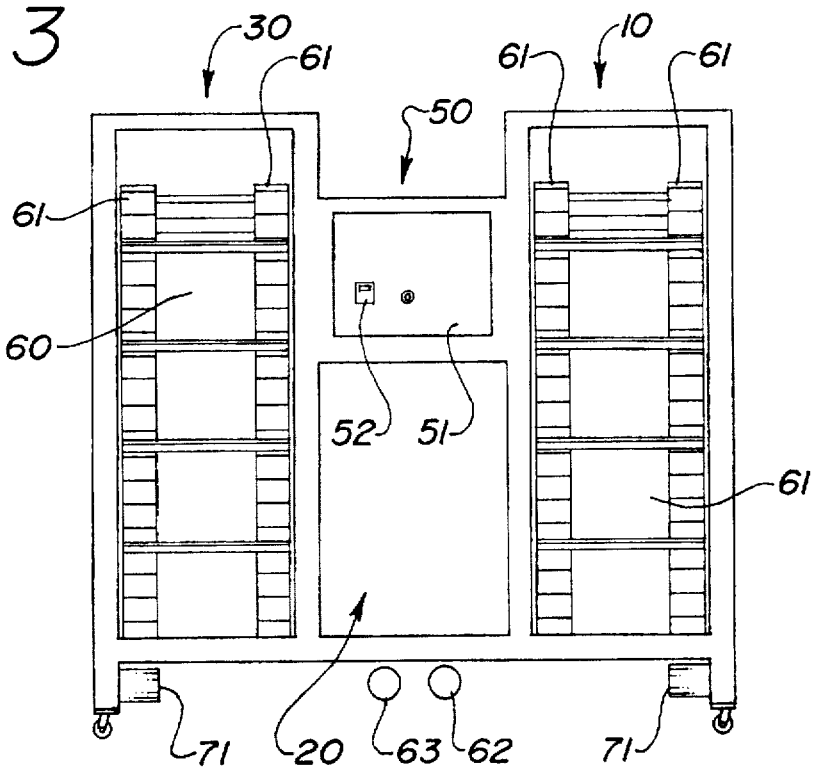
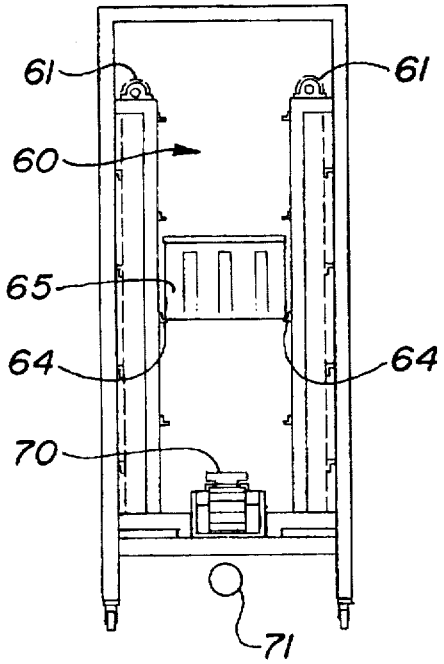
FIG. 4

TO FIG. 7
TO FIG. 7
84
85
FROM VLC OUTPUT O/1
M-1
LOAD
MTR-1
62
84
85
FROM PLC OUTPUT O/2
M-2
UNLOAD
MTR-2
63
84
85
FROM PLC OUTPUT O/3
M-3
FILL
MTR-3
71

120 V.A.C
83
G
POWER SUPPLY
24 V.D.C. @ 1.2A
81
BUS
BUS
EMERGENCY STOP RELAY
EMERG. STOP
EMERG. STOP (PANEL)
DOOR SWITCH LOAD
DOOR SWITCH UNLOAD
OPERATOR PANEL
52
TO FIG. 6
TO FIG. 6

AUTOMATED PRODUCT COLLECTION APPARATUS

BACKGROUND OF THE INVENTION

This invention relates to devices for collecting and storing items and, in particular, to a device for collecting parts produced in manufacturing operations and accumulating the parts in a series of stacked containers.

Modern manufacturing operations can be substantially automated, requiring little human supervision. The "lights out" manufacturing philosophy looks toward the factory in which no human involvement is required for extended periods of time. No human presence equates to no need for lighting; hence, the expression "lights out".

Modern automated manufacturing also is characterized by the large throughput that is possible with programmed, automatic machinery. Even highly precise parts requiring numerous machining operations can be produced in significantly large quantities by a sequence of automated machinery. The combination of high throughput and little need for human intervention available in automated manufacturing environments leads to major problems in the handling of the production output. For example, it may be highly desirable to program a machine or sequence of machines to produce finished parts through the night while no human operators are present, thus avoiding the cost of shift labor and maximizing the utility of relatively expensive automated machinery. The problem resides in how to handle the finished parts which accumulate from the automated lathe or injection molding machine or the like. Simply letting the parts pile up produces more problems with the need to sort, count and organize the parts, thus at least partially obviating the advantages gained by eliminating human labor while the machines are operating. It is thus highly desirable that the parts produced by the automated machinery be collected in some organized fashion so as to maximize the efficiency of the overall production operation.

Similar problems have been addressed in the context of automated production machinery. U.S. Pat. Nos. 5,186,086 and 5,072,635, are indicative of the general state of the art for relatively unsophisticated parts catchers for automatic production machinery. Neither of these patents disclose the ability to accumulate and store the parts in an organized fashion such as in a series of containers, boxes or totes.

There is a large class of patents which employ combinations of horizontal and vertical conveyors to sort and stack articles. Typical of this class is U.S. Pat. No. 4,902,184 which discloses a device in which a sequence of individual packages are delivered from a horizontal conveyor to a vertical conveyor. The vertical conveyor arranges and stacks the packages vertically and transfers them to another horizontal conveyor for output. While this type of patent discloses a combination of horizontal and vertical conveyors for moving articles, it does not disclose the function of accumulating production parts nor does it function to accumulate and store enumerated parts. Another example of this type of patent is U.S. Pat. No. 4,993,907. In all patents of this class the storage function is only incidental to the primary function of stacking the articles.

Conversely, U.S. Pat. No. 4,609,091 is directed to storage rather than sorting of articles received from a horizontal conveyor.

Other patents which relate to the problem of temporarily storing articles unloaded from a conveyor and later returning those articles to a conveyor are U.S. Pat. Nos. 5,337,880 and 4,909,697. The latter discloses the use of a vertical holding conveyors to store a series of empty boxes. Another conveyor stores a series of box units in which quantities of various items have been stored. The operator is able to remove items from the stored boxes and fill the empty boxes until an order is completed. The box may then be dispatched onto a horizontal conveyor.

Other patents relate to filling boxes or other accumulators with a quantity of parts. For example, U.S. Pat. No. 3,633,732 specifically addresses the problem of filling boxes with a preselected quantity of discreet articles. This patent discloses a vertical feed conveyor which deposits articles in a box. As each article is deposited in the box, it is counted. This patent does not, however, disclose any solution to the problem of filling and storing a sequence of boxes.

U.S. Pat. No. 4,074,610 discloses a device for removing rounds of ammunition from shipping/storage containers. The containers are loaded into a vertical conveyor from which the ammunition rounds are extracted and fed to a horizontal conveyor assembly. This patent discloses the converse of the problem of accumulating and storing parts.

U.S. Pat. No. 5,083,411 discloses a stacking station for receiving empty containers and a stacking station for receiving full containers. The stacking stations are arranged in a right angle configuration with respect to a filling station. The containers are stacked in a vertical relationship using a piston and cylinder device.

SUMMARY OF THE INVENTION

In order to overcome the problems and limitations of the prior art, the automated product collection apparatus of the present invention comprises two vertical, endless belt conveyor systems and a horizontal conveyor. One of the vertical conveyors (the load station) is loaded with a number of empty totes or containers which are transferred sequentially to the horizontal conveyor (the fill station). The horizontal conveyor moves an empty container into position to collect parts from process and production equipment such as injection molding machines, lathes and the like. Sensing circuitry may be provided to count the parts loaded into each waiting container so as to determine when each container is full or reaches a predetermined product count. The full container is then moved to the second vertical conveyor system (the unload station) which accumulates the full containers. The full containers may then be unloaded from the second vertical conveyor as needed; for example, after a night of automated product manufacturing. Various refinements to the system are chiefly related to the sensor circuitry so that individual parts may be counted, the accumulated total of parts can be weighed, and inputs may be obtained from other automated production equipment.

The overall concept of the present invention is to collect items from process and production equipment such as plastic injection molding machines, automated assembly machines, conveyors, lathes and the like and to provide long spans of zero operator intervention. It also aids in inventory control since all parts are automatically counted, weighed, or otherwise enumerated in some manner as they are placed into containers.

The automated product collection apparatus functions as a self contained unit. It may be powered by 120 volts AC and would require no other source of energy. It has three stations which are herein referred to as load, unload and fill stations. The load station and the unload station each comprise vertical conveyors, while the fill station comprises a horizontal conveyor. The operator loads empty containers or accumulators (totes, boxes, bins, plates or the like) into the load station. After the containers are filled, the operator unloads full containers at the unload station. The products, parts or items (these terms are used herein interchangeably) to be collected are deposited into the container at the fill station. The automated product collection apparatus interacts or directly interfaces with other equipment via sensor input into its control system and through an operator interface panel. In addition, the system has the capability of interfacing with any machine that has microprocessor control.

The load station functions as an entry point for the product container. The container may be a tote, box, bin or any type of accumulator which meets the need of the item to be collected. (Herein, any of the various terms denoting a container, including without limitation, tote, box, bin, plate, or accumulator, are considered to be equivalent.) The number of containers is adjustable in a vertical direction.

The unload station functions as an exit point for the product containers. When any or all product containers are full they may be removed from the unload station.

The fill station serves as the area where the product is dispensed into the containers. The product may be dispensed into the automated product collection apparatus in a number of ways. A gravity slide, pick-and-place robot or product conveyor would be typical means of filling the containers from the various types of production equipment. The fill station may determine that it has filled the accumulator or container by a variety of methods. Various embodiments of the automated product collection apparatus include:

a) Remote sensor input from an inductive or capacitative proximity switch into the automated product collection apparatus's Programmable Logic Controller (PLC). The PLC counts the parts loaded by sensing each time that the sensor has been activated. The number of parts that constitutes a full container is adjustable via an operator interface panel.

b) Remote sensor input from an opto-electronic device into the automated product collection apparatus's PLC. The PLC counts the number of times that a light beam is broken. The count is adjustable via an operator interface panel.

c) Remote sensor input from a mass/weight/density sensing device. The automated product collection apparatus's PLC monitors mass/weight/density of the container to determine when it is full and cycle the stations accordingly.

d) Operator adjustable cycle time implemented using an internal timer in the control system.

All three stations are contained in a compact, well guarded frame. Many different sizes and styles of vertical stackers may be employed without changing the general appearance or function of the apparatus.

It is thus an object of the present invention to provide for an apparatus to collect parts from automated production machinery, assembly lines, conveyor systems and the like.

It is a further object of the present invention to provide for automated storage of accumulated parts.

It is an additional object of the present invention to provide for counting, weighing, or similar accounting for the accumulated parts.

It is a still further object of the present invention to provide for the storage of accumulated parts in individual totes or containers stacked in a vertical conveyor for ease and efficiency of storage and unloading.

Additional objects and advantages of the present invention will appear from the detailed description of the preferred embodiments in conjunction with the appended drawings in which:

BRIEF DESCRIPTION OF THE DRAWINGS

FIG. 1 is a front perspective view of the automated product collection apparatus.

FIG. 2 is a top plan view of the automated product collection apparatus.

FIG. 2A is a top plan sectional view of the automated product collection showing the horizontal conveyor.

FIG. 3 is a front elevation view of the automated product collection apparatus.

FIG. 4 is a side elevation view of the automated product collection apparatus.

DETAILED DESCRIPTION OF THE PREFERRED EMBODIMENTS

Figure 5:
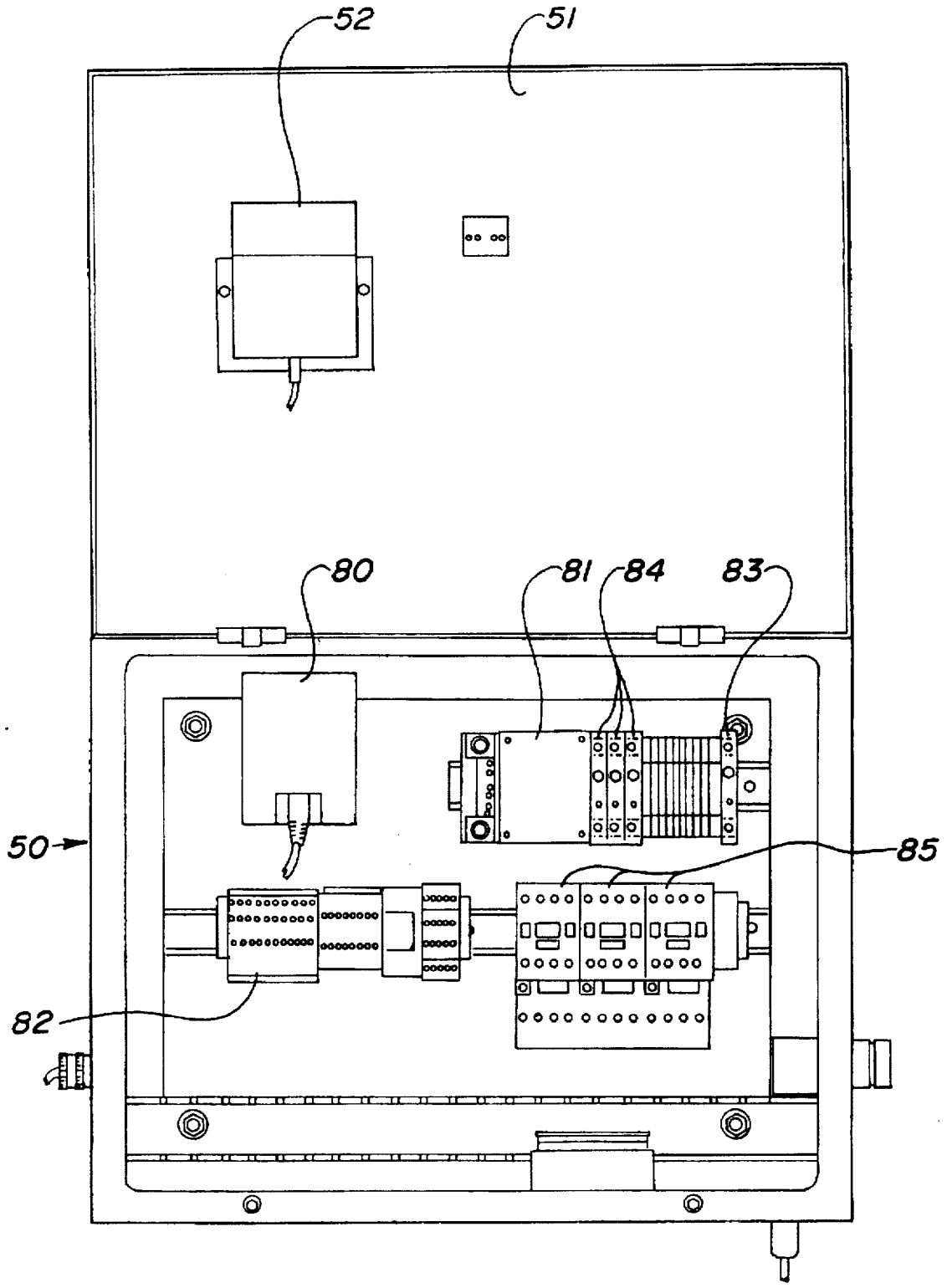
FIG. 5 is a partial elevation view of the opened electronics cabinet.

The general appearance of the automated product collection apparatus of the present invention may be described with respect to FIG. 1. The automated product collection apparatus comprises a loading station 10, a filling station 20, and an unloading station 30. The loading station 10, filling station 20 and unloading station 30 are disposed within a unitary framework 40 having appropriate means for protecting and guarding the internal workings of the apparatus and for providing access thereto. Access to the loading station 10 is by access door 11. Similar guarded access may be provided to the unloading station 30. The particular form of the frame 40, including means of enclosure and access, are not critical to the functioning of the invention and various forms of enclosure and access well known in the art would be suitable for use in the practice of the invention.

The apparatus also comprises an electronics cabinet 50 having a front mounted access door 51 and an operator panel 52 for information output from and input to a programmable logic controller (PLC) as described more fully hereinafter.

The operation of the loading station 10, filling station 20 and unloading station 30 are described with reference to FIGS. 1, 2, 2A, 3 and 4. It should be noted that FIG. 4 represents either the loading station 10 or the unloading station 30, since the physical appearance of either station from the side is identical. The operation of the two stations is similar though in reverse order.

Both the loading station 10 and the unloading station 30 comprise vertical conveyors 60, which, in the preferred embodiment, are in turn comprising two pairs of endless conveyor belts 61. The endless conveyor belts 61 are disposed vertically so as to move in either a vertically upward or vertically downward direction. The appropriate mechanical components, including pulleys and gearing, for effecting the motion of the endless conveyor belts 61 are well known in the art and are therefore not shown on the appended drawings. The motive power to effect the operation of the endless conveyor belt 61 is provided by load station motor 62 and unload station motor 63.

The endless belt conveyor 61 are provided with lifting brackets 64 which are arranged in complementary pairs as shown in FIG. 4. The lifting brackets 64 are disposed so as to slidably receive a series of containers 65. The term "container" or "tote" or the like are considered to be equivalent and are used interchangeably herein. While FIG. 4 only shows one container 65 in position on a complementary pair of lifting brackets 64, it should be understood that a series of containers 65 in a stacked vertical relationship may occur in either the loading station 10 or the unloading station 30 at any one time. Once a container 65 has been placed into either the loading station 10 or the unloading station 30, the container 65 may be translated vertically in either an upward or a downward direction by operation of the vertical conveyor 60.

The operation of the loading station 10 may be described as follows: a series of empty containers 65 may be inserted into the loading station 10 by sliding each container 65 horizontally onto a complementary pair of lifting brackets 64. When the loading station 10 is completely loaded with empty containers 65, it may be seen that the result is a plurality of empty containers 65 stacked in a vertical relationship with each empty container 65 supported on its respective pair of complementary lifting brackets 64. The operation of the vertical conveyor 60 comprising the pair of endless belts 61 in a vertically downward direction translates each of the empty containers 65 in a vertically downward direction sequentially to the bottom of the loading station 10. Upon reaching the bottom of the loading station 10 the empty container 65 rests upon a horizontal conveyor 70. As the downward vertical motion of the vertical conveyor 60 continues, the pair of respective, complementary lifting brackets 64 retracts from the bottom of the empty container 65 as the lifting brackets 64 reach the bottom of the endless belt 61. The lifting brackets 64 are then carried around the endless belt 61 to the top of the vertical conveyor 60.

The horizontal conveyor 70 is operated by conventional mechanical means so as to translate the empty container 65 horizontally from the loading station 10 to the filling station 20. The motive power for operation of the horizontal conveyor 70 is provided by fill motor 71. While disposed at the filling station 20, the empty container 65 may be filled with items by various means, such as a gravity slide, pick and place robot, or product conveyor. The source of the collected items could include injection molding machines, end of line conveyors, CNC lathes or mills, or other types of automated production equipment. Sensing means may determine when the container 65 is filled in a manner to be described more fully hereinafter.

Once the container 65 is full, the horizontal conveyor 70 translates the filled container 65 horizontally to the bottom of the unloading station 30.

At the unloading station 30, the vertical conveyor 60 operates in reverse fashion to the description of the vertical conveyor 60 at the loading station 10 given above. The vertical conveyor 60 at the unloading station 30 operates in a vertically upward direction. Initially the full container 65 is resting on the horizontal conveyor 70 at the bottom of the unloading station 30. As the vertical conveyor 60 operates in a vertically upward direction, a pair of complementary lifting brackets 64 engages the bottom of the full container 65. As the vertical conveyor 60 continues to move in a vertically upward direction, the full container 65 is translated vertically upward from the horizontal conveyor 70. By repeating these steps a plurality of full containers 65 may be accumulated in a stacked vertical relationship.

The operation of the apparatus is controlled by a "programmable logic controller" or PLC 80. The PLC 80 is of a conventional type well known in the art and will not be described in detail herein.

Figure 6:
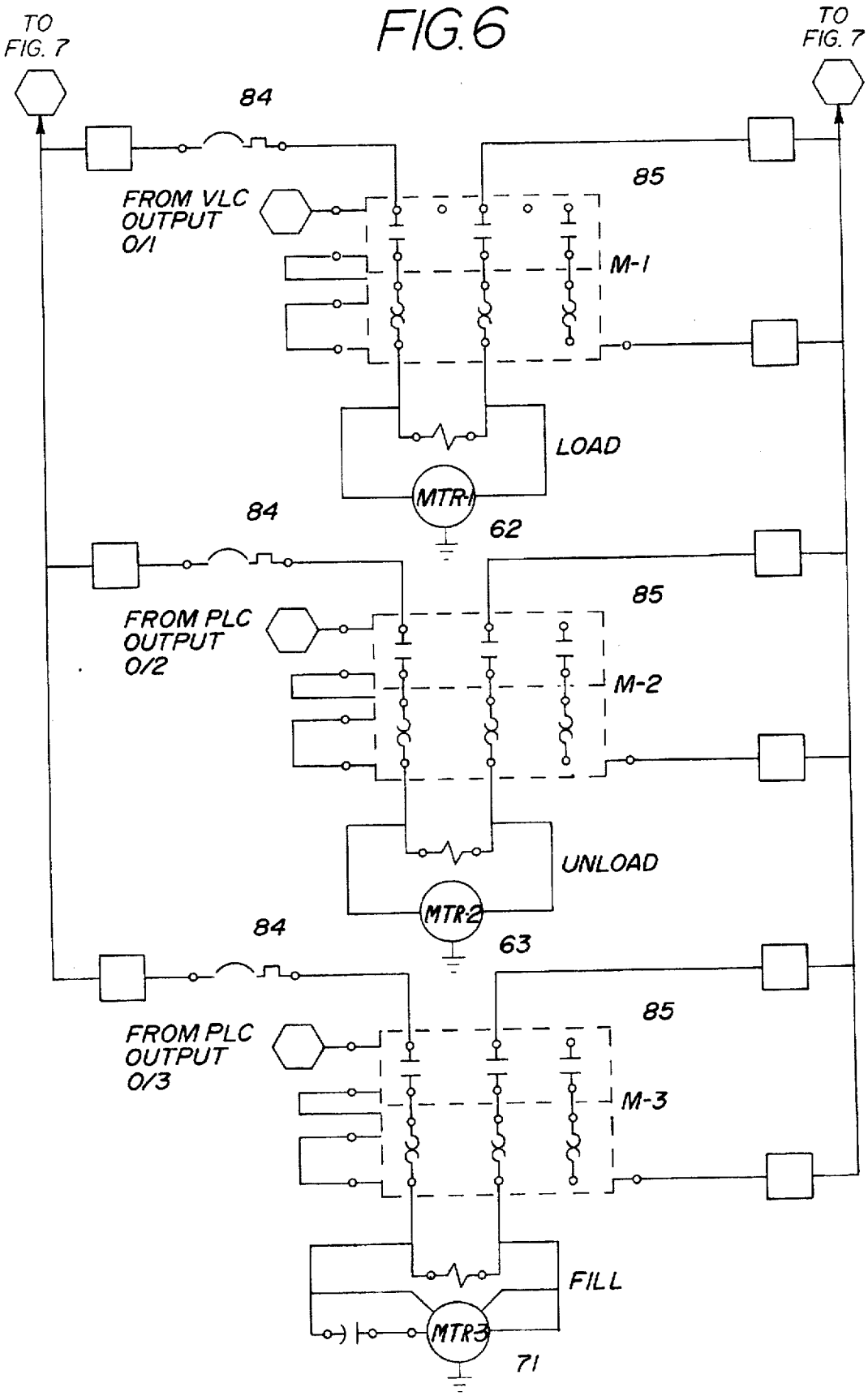
FIG. 6 is an electrical schematic of the motor control circuitry.
Figure 7:
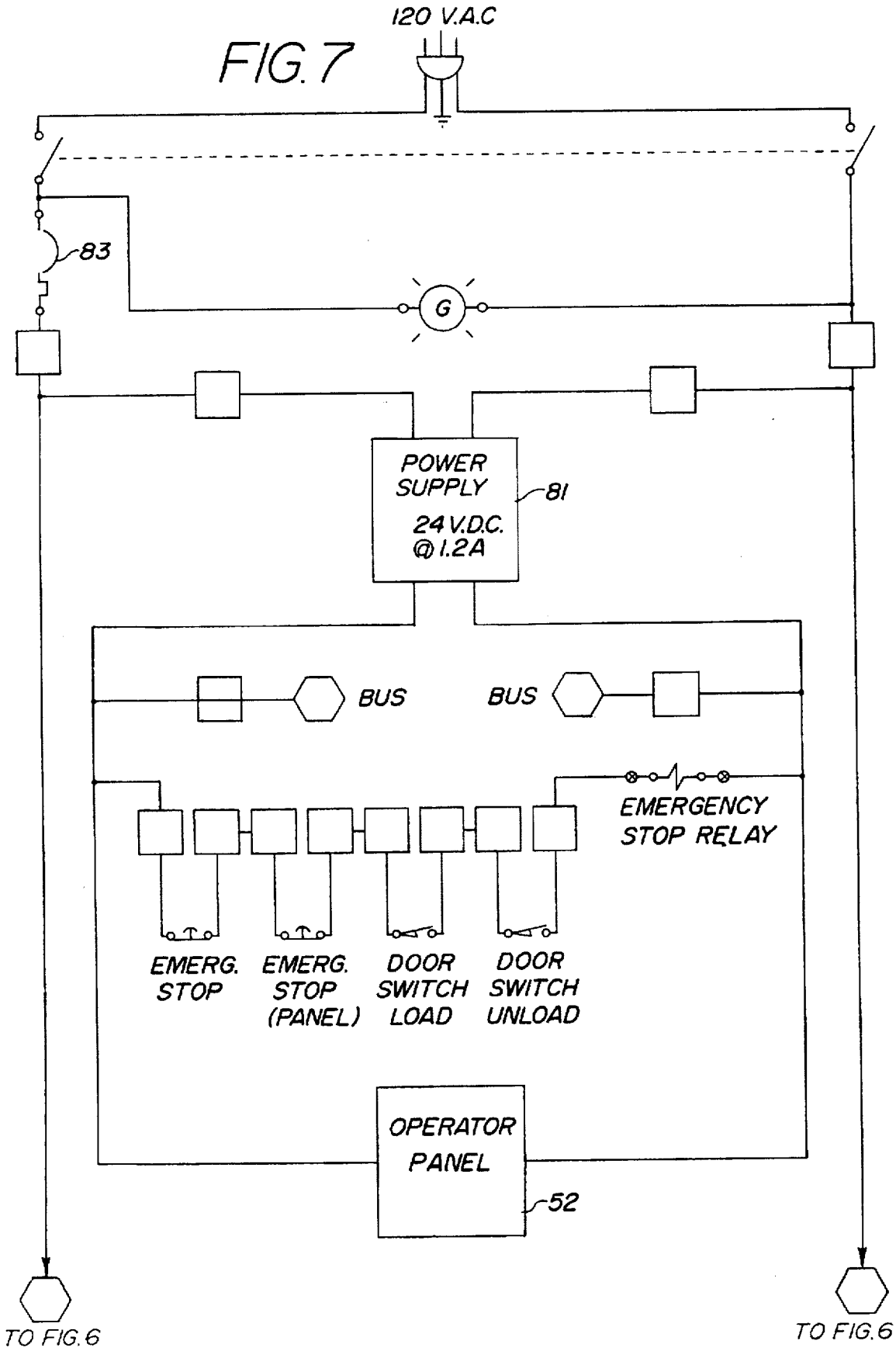
FIG. 7 is an electrical schematic of the power supply circuitry.
Figure 8:
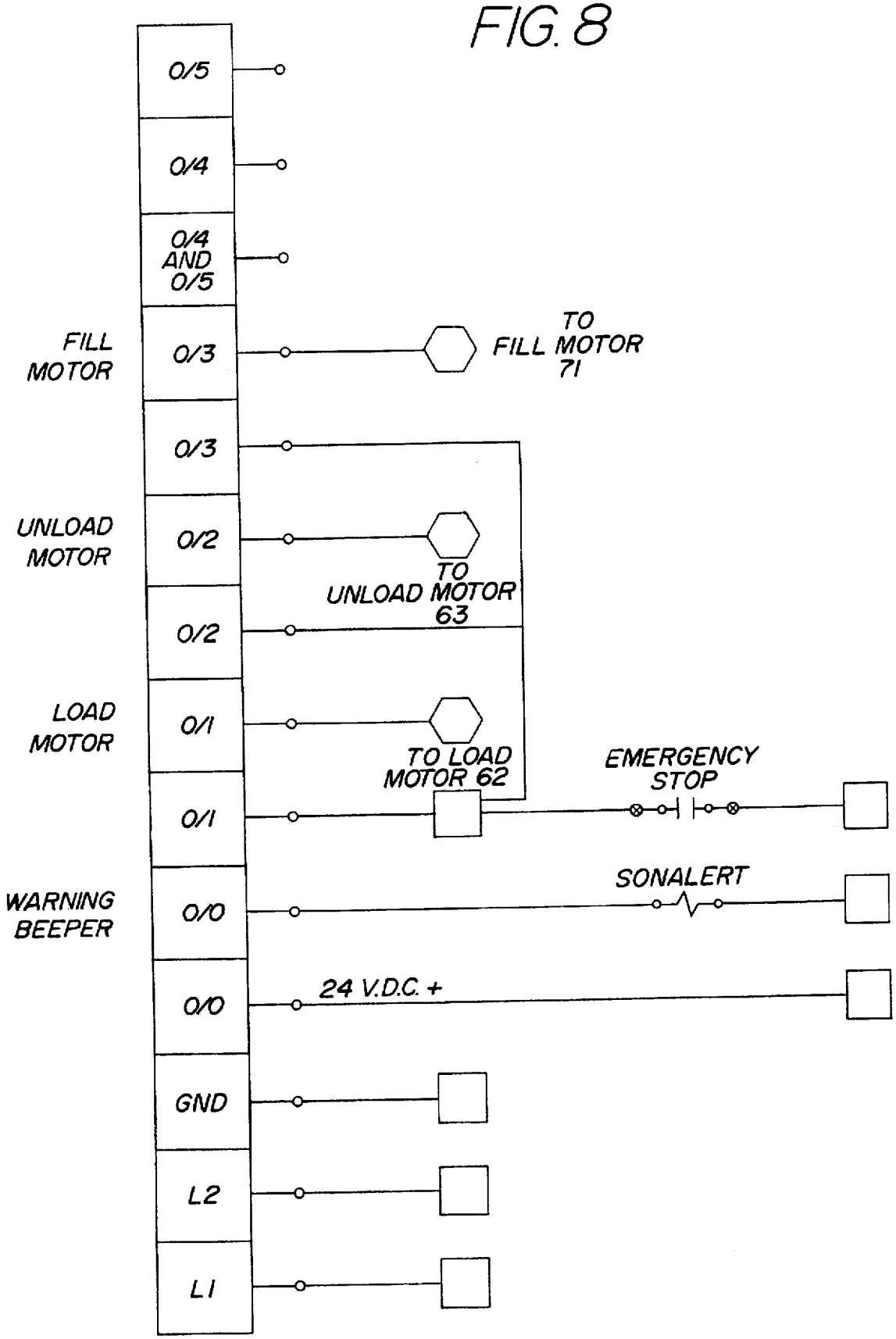
FIG. 8 is an electrical schematic of the PLC outputs.
Figure 9:
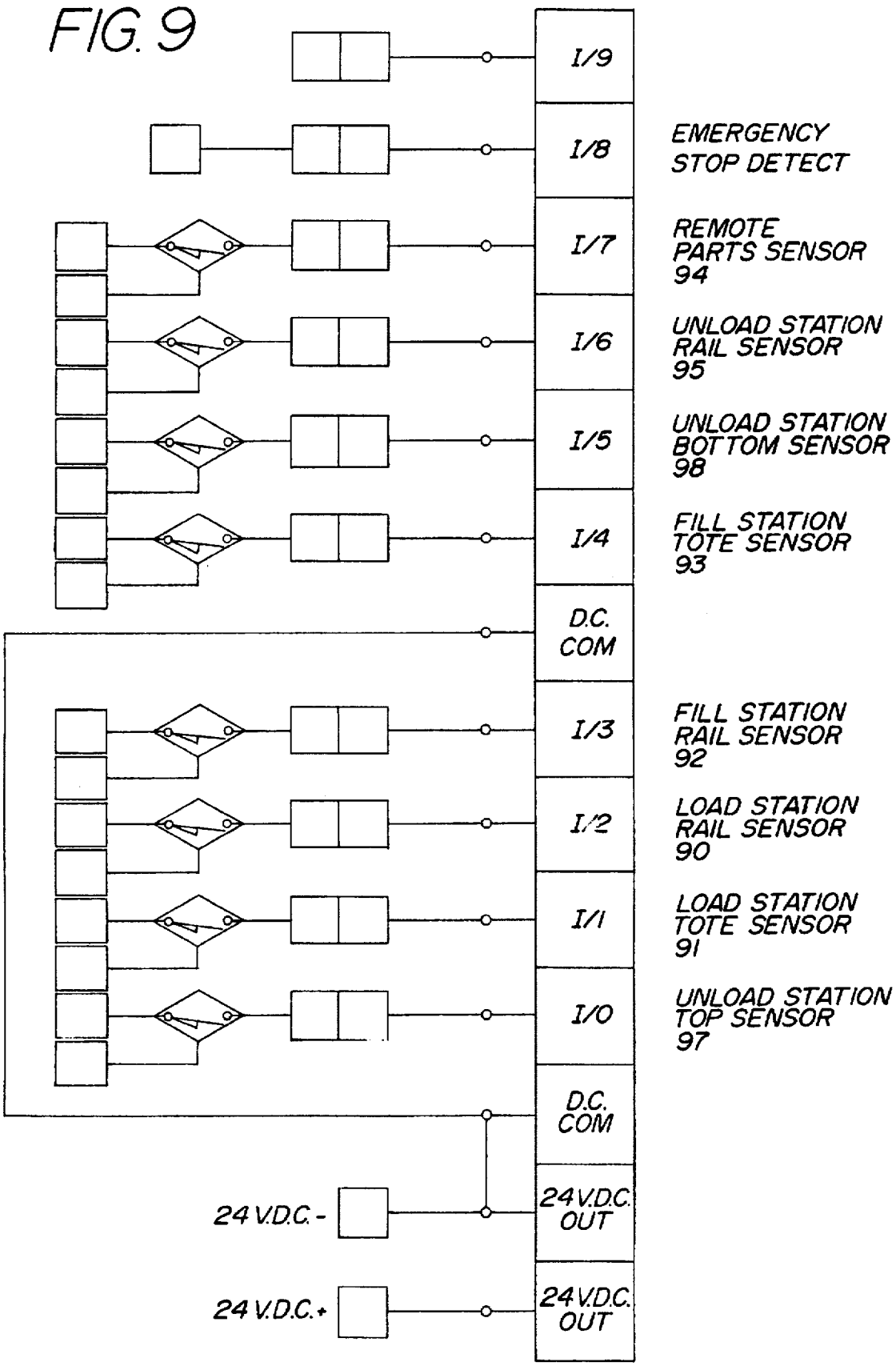
FIG. 9 is an electrical schematic of the PLC inputs.

The physical disposition of the electronic components of the present invention may be described with reference to FIG. 5. As described previously, the electronics cabinet 50 is provided with an access door 51 having an operator panel 52 disposed thereon. The operator panel 52 communicates electronically with the PLC 80. Also disposed within the electronics cabinet 50 are a 24-volt power supply 81, a terminal block 82 for both 110-volt A.C. power and 24-volt D.C. power, main circuit breaker 83, motor circuit breakers 84, and motor starters 85. FIGS. 6 and 7 are electrical schematics showing the conventional electrical interconnections of these components. FIGS. 8 and 9 are output and input schematics respectively for the PLC 80.

Figure 10:
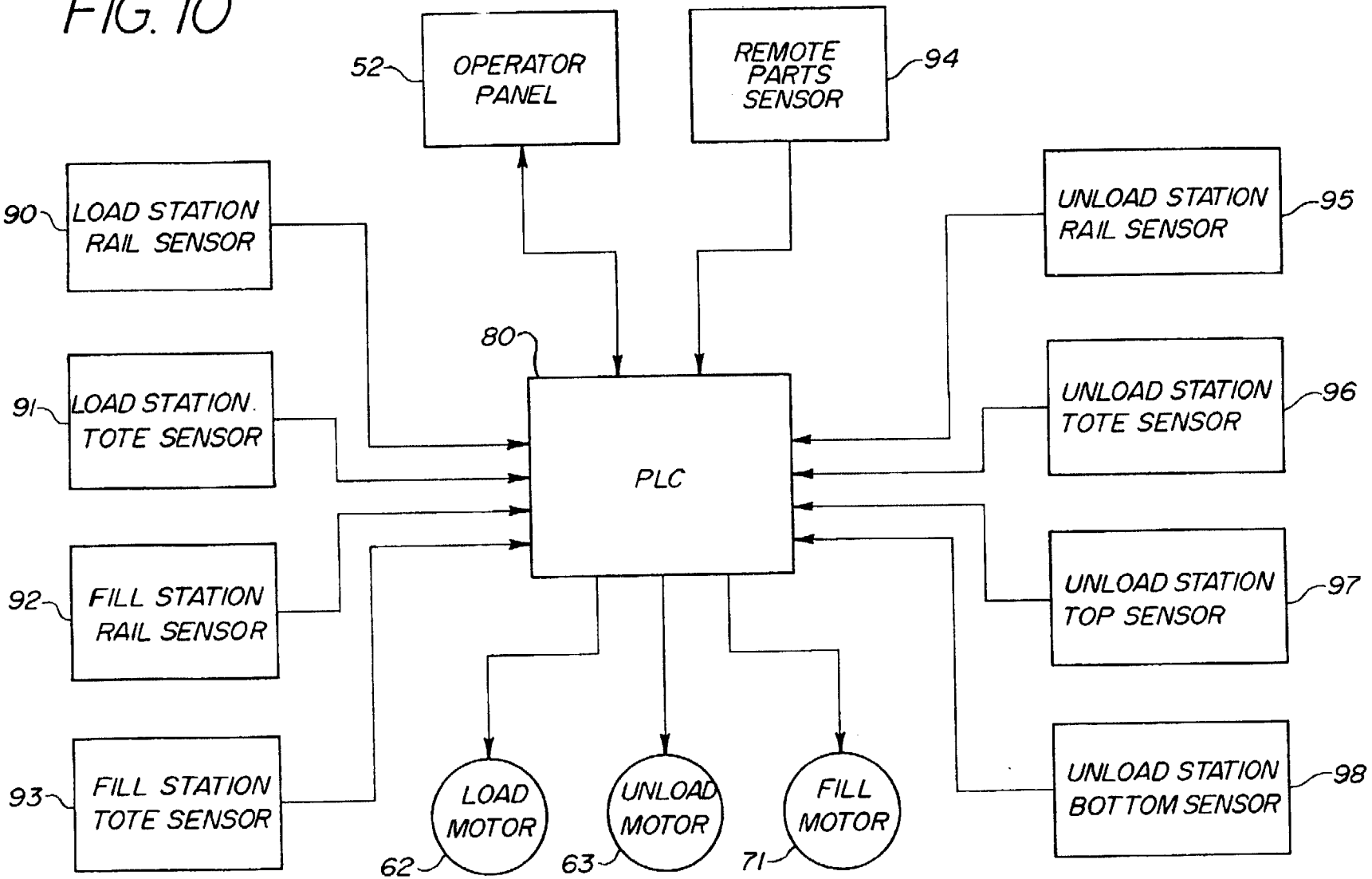
FIG. 10 is a block diagram of the PLC, its inputs and outputs.

The overall operation of the apparatus may be described with reference to FIG. 10. First, the load station 10 is loaded with a plurality of empty containers 65. The PLC 80 recognizes a requirement to place an empty container 65 at the fill station 20 in order to receive items being produced by the production equipment. The PLC 80 activates load motor 62 to operate the vertical conveyor 60 at the load station 10 so as to move an empty container 65 to the bottom of the load station 10. By means of a load station rail sensor 90, the PLC 80 receives an input signal to indicate that the lifting bracket (or rail?) 64 has been moved to the appropriate position to place an empty container 65 on the horizontal conveyor 70. The PLC 80 then sends a signal to load motor 62 to stop. Since the next sequential position on the vertical conveyor 60 at the load station 10 may not actually contain an empty container 65, a load station tote sensor 91 signals the PLC 80 as to whether an empty container 65 is actually present at the bottom of the load station 10.

If an empty container 65 is present at the bottom of the load station 10, the PLC 80 activates fill motor 71 to translate the empty container 65 by means of the horizontal conveyor 70 from the bottom of the load station 10 to the fill station 20. The fill station rail sensor 92 senses whether the horizontal conveyor 70 has moved to the appropriate position at the fill station 20. If so, a signal is sent to the PLC 80 so as to stop the fill motor 71. Furthermore, the fill station tote sensor 93 senses whether an empty container 65 is actually present at the fill station 20. If the load station tote sensor 91 or the fill station tote sensor 93 senses that an empty container 65 has not been moved to the fill station 20, then the PLC 80 continues the process outlined above until an empty container 65 is present at the fill station 20.

At the fill station 20, the empty container 65 is placed into a position to receive items from various types of automated production equipment as described above. Various means may be employed to determine when the container 65 has been filled with product items. For example, parts counters of either the inductive or capacitative type may be employed to individually count each part as it is deposited in the container 65. Other types of part counters include interruptable light beams. Any of the types of parts counters well known in the art could be used to count each item as it is placed in the container 65. A full parts count may have been previously entered into the PLC so that when a full parts count is reached, the PLC 80 is activated to move the full container 65 to the next stage in the process.

Other types of sensors may be employed to signal the PLC 80 that the container 65 is full. For example, a weight sensor may be employed to determine when a particular weight of items has been reached. Also, a cycle timer may be employed to determine that a particular duration of time has elapsed which indicates a full container 65. Also, outputs from automated production machinery may be used to signal that the container 65 has reached a full state. All of these various techniques as well as other methods of sensing the quantity of parts placed in the container 65 may be employed to signal the PLC 80 that the container 65 is full. All of these various techniques are encompassed under the term remote parts sensor 94 in FIG. 10.

When the remote parts sensor 94 has provided the appropriate input to the PLC 80 to indicate that the container 65 is full, the PLC 80 activates fill motor 71 to translate the full container 65 by the horizontal conveyor 70 to the bottom of the unloading station 30. The unload station bottom sensor 98 signals the PLC 80 that no tote or container is present at the bottom of the unload station 30, and therefore that a full container 65 may be translated by the horizontal conveyor 70 to the bottom of the unload station 30.

Similarly to the load station 10, the unload station 30 has an unload station rail sensor which senses whether the vertical conveyor 60 has moved to the appropriate position at the bottom of the unload station 30. Further, the unload station tote sensor 96 signals the PLC 80 that a container 65 is actually present at the bottom of the unload station 30. If a container 65 is actually present the unload striate position at the bottom of the unload station 30, the PLC 80 activates unload motor 63 so as to operate the vertical conveyor 60 at the unload station 30 in a vertically upward direction. The full container 65 is then translated vertically upward to the next position in the unload station 30. By repeating this sequence of events, a plurality of full containers 65 may be accumulated in a vertically stacked relationship at the unload station 30. When a full container 65 has reached the top of the unload station 30, an unload station top sensor 97 signals the PLC 80 that the unload station is full. This allows an operator to remove full containers 65 from the unload station 30 so as to continue the process.

It is to be understood that the present invention has been described with reference to certain preferred and alternative embodiments which are exemplary only and not by way of limitation to the full scope of the present invention as set forth in the appended claims.

What is claimed is:

1. An apparatus for accumulating items in a series of containers, comprising:

(a) a loading station for storing a plurality of said containers in an empty state, wherein said loading station further comprises means for storing said containers in a vertically stacked relationship, and further wherein said means for storing of said loading station comprises a vertical conveyor comprising at least one pair of endless belts having disposed thereon a plurality of complementary lifting brackets for engaging in a horizontally sliding fashion the bottom of each of said containers, whereby said containers may be supported on and vertically translated sequentially by said vertical conveyor to the bottom of said loading station, and further whereby said lifting brackets disengage from each of said containers upon reaching said bottom of said loading station;

(b) a filling station for filling said containers with said items, said filling station further comprising sensing means for sensing a predetermined full state for each of said containers;

(c) an unloading station for storing a plurality of said containers in a full state, wherein said unloading station further comprises means for storing said containers in a vertically stacked relationship, and further wherein said means for storing of said unloading station comprises a vertical conveyor comprising at least one pair of endless belts having disposed thereon a plurality of complementary lifting brackets for engaging in a horizontally sliding fashion the bottom of each of said containers whereby said containers may be supported on and vertically translated sequentially by said vertical conveyor from the bottom of said unloading station and further whereby said lifting brackets engage each of said containers upon being horizontally translated into said bottom of said unloading station; and (d) means for horizontally translating said containers from said loading station to said filling station and from said filling station to said unloading station, wherein said means for horizontally translating comprises a single horizontal conveyor belt for horizontally translating an empty container from said bottom of said loading station to said filling station and horizontally translating a filled container from said filling station to said bottom of said unloading station.

2. The apparatus of claim 1 wherein said sensing means comprises an inductive parts counter.

3. The apparatus of claim 1 wherein said sensing means comprises a capacitative parts counter.

4. The apparatus of claim 1 wherein said sensing means comprises an interruptable light beam parts counter.

5. The apparatus of claim 1 wherein said sensing means comprises a weight sensor.

6. The apparatus of claim 1 wherein said sensing means comprises a cycle timer.

7. The apparatus of claim 1 wherein said sensing means comprises output from automated production machinery.

* * * * *